US005643032A

United States Patent [19]

Cheng et al.

[11] Patent Number: 5,643,032

[45] Date of Patent: Jul. 1, 1997

[54] METHOD OF FABRICATING A FIELD EMISSION DEVICE

[75] Inventors: Huang-Chung Cheng, Hsinchu; Tzu-Kun Ku, Taipei, both of Taiwan

[73] Assignee: National Science Council, Taipei, Taiwan

[21] Appl. No.: 438,147

[22] Filed: May 9, 1995

[51] Int. Cl.[6] ..... H01J 9/02

[52] U.S. Cl. ..... 445/24; 445/50

[58] Field of Search ..... 445/24, 35, 50, 445/51

[56] References Cited

U.S. PATENT DOCUMENTS

| | | | |
|---|---|---|---|
| 4,172,005 | 10/1979 | Muraoka et al. | 257/506 X |
| 5,228,878 | 7/1993 | Komatsu | 445/50 |
| 5,394,006 | 2/1995 | Liu | 445/50 X |
| 5,401,676 | 3/1995 | Lee | 445/50 X |
| 5,506,476 | 4/1996 | Lee et al. | 445/35 X |

FOREIGN PATENT DOCUMENTS 174087 12/1991 Taiwan .

OTHER PUBLICATIONS

Busta "Vacuum microelectronics–1992" *Journal of Micromechanics and Microengineering* vol. 2, No. 2, pp. 54–56 (1992).

*Primary Examiner*—Kenneth J. Ramsey

*Attorney, Agent, or Firm*—Townsend and Townsend and Crew LLP

[57] ABSTRACT

A method for fabricating a field emission device comprises the steps of forming a capping layer (20) on a silicon substrate (2) and etching the substrate to form a silicon pedestal (22) beneath the capping layer. A dielectric layer (24) is then formed along the side walls of the silicon pedestal and the surface of the silicon substrate, simultaneously sharpening the silicon pedestal into a silicon tip (26). A metal layer (28) is deposited over the capping layer and the dielectric layer such that a portion of the dielectric layer beneath the capping layer remains exposed. Finally, hydrofluoric acid is employed to lift off the capping layer and the metal layer disposed thereon and to etch the dielectric layer, thereby exposing the silicon tip as an emitter and the remaining metal layer as a gate. Since the spacing between the emitter and the gate is only limited by the thickness of the dielectric layer, it is possible to generate a submicron-scale gate aperture without the use of submicron-lithography techniques.

15 Claims, 7 Drawing Sheets

METHOD OF FABRICATING A FIELD EMISSION DEVICE

BACKGROUND OF THE INVENTION

1. Field of the Invention

The invention relates generally to a manufacturing process for a vacuum microelectronics device and more particularly to a method for fabricating a field emission device (FED) having a uniform silicon tip as an emitter and a submicron-scale gate aperture which can reduce the operating voltage of the device.

2. Description of the Related Art

Ever since C. A. Spindt set forth a description of a micrometer-scale gated field emission device (FED) in 1969, such devices have been conventional in the field of vacuum microelectronics. Until now, there have been two predominant methods for fabricating the field emission device. One of these methods uses the metal evaporation technique similar to Spindt's, and the other makes use of the current IC (integrated circuits) fabrication process, especially silicon-based ICs. There are, however, at least two deficiencies encountered with Spindt's method. First, it is difficult to control the uniformity of a plurality of emission tips formed over a large area, e.g., an array of field emission devices, with metal evaporation techniques. Second, extra equipment, such as an oblique-angle evaporator or a substrate-holder spinner, must be bought because such devices are not involved in the standard CMOS process. Moreover, these devices complicate the process flow and limit the formation of silicon tip arrays over a large area. By comparison, the second method of utilizing the IC fabrication process simplifies the process steps.

The above methods for fabricating field emission arrays have been further classified into two rough categories: the self-aligned and the non-self-aligned methods. Since the operating voltage of a field emission device is proportional to the spacing between a gate and an emitter tip, this operating voltage can be lowered by decreasing the distance between the gate and the tip. To lower the operating voltage, the width of the gate aperture is typically decreased to approach the emitter tip as closely as possible without making contact. In addition, it is critical that the emitter tip is aligned symmetrically within the center portion of the gate aperture to reduce the leakage current induced therefrom. The non-self-aligned method, however, cannot meet the above requirements, and therefore is inferior to the self-aligned method. The self-aligned method typically meets these requirements by employing a lift-off technique.

FIGS. 1A–1E illustrate the process steps of a conventional lift-off technique for fabricating a field-emission device. As shown in FIG. 1A, an oxide or nitride layer (not shown) is formed over a silicon substrate 1, such as single crystalline silicon, polysilicon or amorphous silicon, by thermal oxidation or deposition. Through application of the lithography technique, the oxide or nitride layer is then patterned into a capping layer 10 for defining the position of an emitter.

Referring to FIG. 1B, the surface of the silicon substrate 1 is masked with capping layer 10 and etched into a silicon cone 12, projecting over the silicon substrate 1, by means of wet etching or isotropic dry etching. The top region of the silicon cone 12 adjacent to the capping layer 10 is typically about 1000 Å in width.

As shown in FIG. 1C, thermal oxidation is then applied to the silicon substrate 1 and the side walls of the silicon cone 12 to form an oxide layer 14. Simultaneously, the thermal oxidation consumes a portion of the silicon material, thereby sharpening the silicon cone 12 into a silicon tip 16. To ensure that the silicon cone 12 is sharpened and not completely removed, the oxide layer 14 typically will not exceed 800 Å in thickness.

Referring to FIG. 1D, a dielectric layer 100, such as silicon oxide, and a metal layer 18 are subsequently deposited over the capping layer 10 and the oxide layer 14, respectively, by perpendicular direction physical vapor deposition (PVD), such as E-Gun evaporation. Capping layer 10 serves to mask the portion of oxide layer 14 directly over silicon cone 16. Finally, diluted hydrofluoric acid is employed to etch a portion of the oxide layer 14 disposed on the side walls of the silicon tip 16, as shown in FIG. 1E. The acid also lifts off the portions of capping layer 10 accompanying the dielectric layer 100 and the metal layer 18 thereon to expose silicon tip 16 as an emitter. The remaining metal layer 18 serves as a gate and the gate aperture 19 defines the spacing between the emitter and the gate.

The above described conventional fabrication process has a number of drawbacks. First, the dimensions of the gate aperture 19 are limited by the size of the capping layer 10 (see FIG. 1D). Second, the dielectric layer 100 cannot withstand high voltage because it has been formed by E-Gun evaporation. Third, the thickness of the dielectric layer 100 typically determines the relative geometric position between the emitter and the gate, thereby having a large effect on the electrical characteristics of the field emission device. The E-Gun evaporation process, however, does not provide sufficient control to accurately fabricate a uniform dielectric layer 100. Over a larger area, this non-uniform dielectric layer typically produces divergent device characteristics, which is an undesired attribute for a field emission device.

SUMMARY OF THE INVENTION

The present invention is directed to a method for fabricating a field emission device having a submicron sized gate aperture so that the operating voltage can be reduced. A capping layer is formed on a silicon substrate and the substrate is then etched to form a silicon pedestal from the substrate beneath the capping layer. A dielectric layer is formed along the side walls of the silicon pedestal and the surface of the silicon substrate, simultaneously sharpening the silicon pedestal into a silicon tip. A metal layer is then deposited over the capping layer and over a first portion of the dielectric layer such that a second portion of the dielectric layer beneath the capping layer remains exposed. Hydrofluoric acid is employed to lift off the capping layer and the portion of the metal layer thereon and to etch the dielectric layer to thereby expose the silicon tip as an emitter and the remaining metal layer as a gate.

One advantage of the above method is that the dielectric layer is formed directly on the sides of the silicon tip (rather than only being formed on either side of the capping layer which is typical with conventional processes). Accordingly, the width of the gate aperture is determined by the dielectric layer instead of the capping layer and a submicron sized gate aperture can be fabricated without the use of submicron lithography techniques. The smaller gate aperture decreases the space between the gate and emitter tip, thereby lowering the operating voltage. In addition, the emitter tip is symmetrically located in the center of the gate aperture.

Another advantage of the above method is that the dielectric layer is relatively uniform over an array of field emission devices because it is formed by thermal oxidation; rather than by an evaporation process. In addition, the process can be incorporated into a mature integrated circuit fabrication technique without requiring the purchase of additional equipment, thereby increasing the yield and the reliability of the field emission devices.

BRIEF DESCRIPTION OF THE DRAWINGS

The present invention can be more fully understood by reference to the following description and accompanying drawings, which form an integral part of this application.

DESCRIPTION OF THE PREFERRED EMBODIMENTS

Figure 1A:
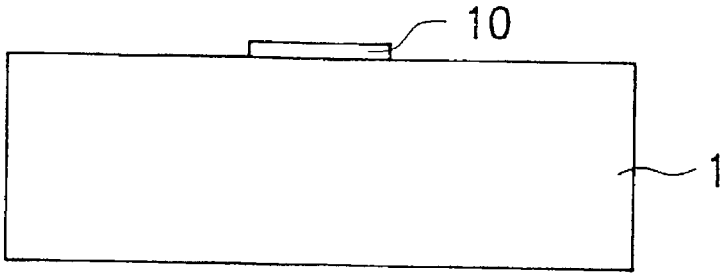
FIG. 1A(PRIOR ART)
FIGS. 1A–1E are cross-sectional views of a conventional process flow for fabricating a field emission device.
Figure 1B:
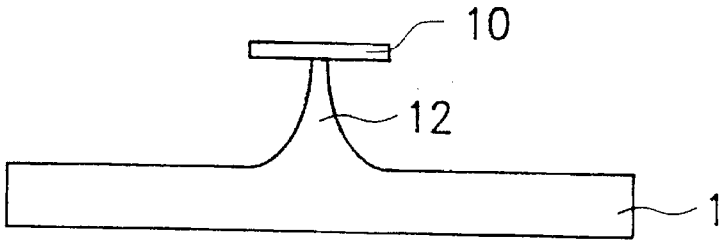
FIG. 1B(PRIOR ART)
Figure 1C:
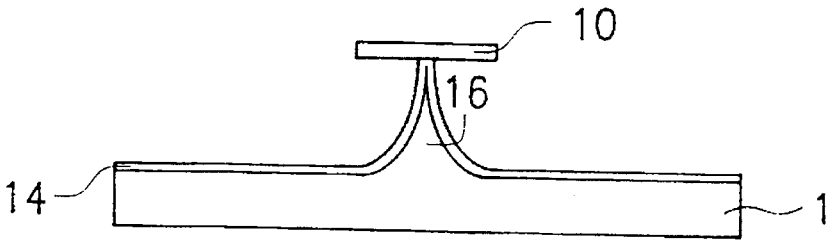
FIG. 1C(PRIOR ART)
Figure 1D:
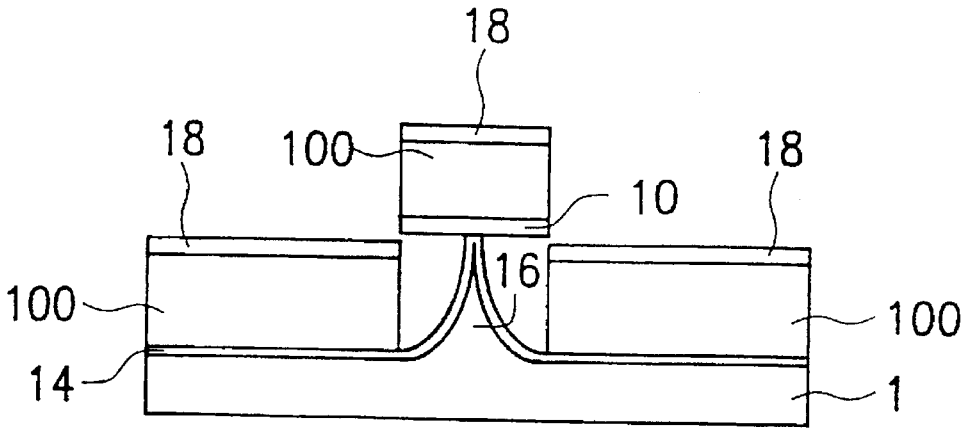
FIG. 1D(PRIOR ART)
Figure 1E:
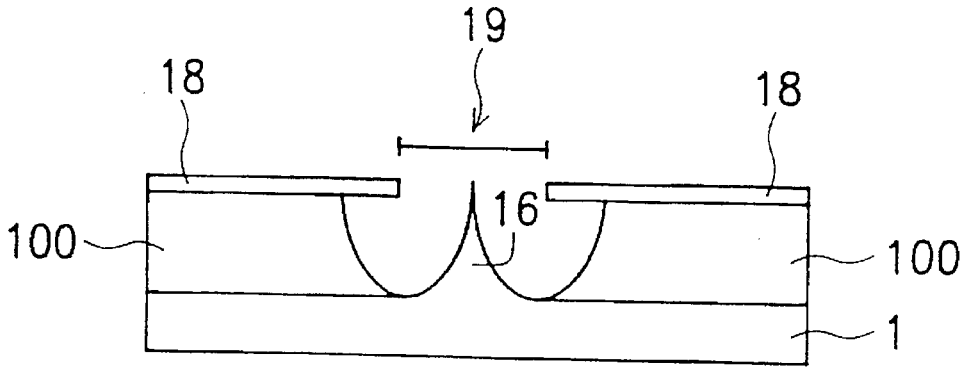
FIG. 1E(PRIOR ART)
Figure 2A:
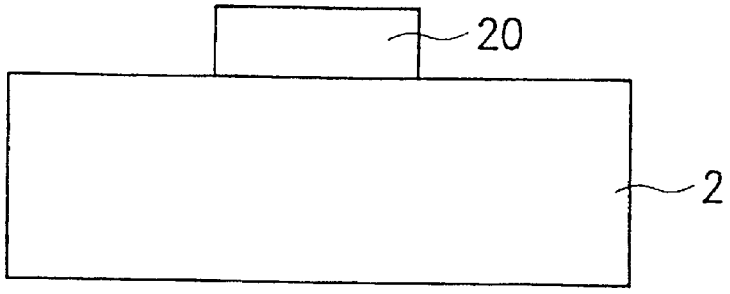
FIGS. 2A–2E are cross-sectional views of the process steps for fabricating a field emission device according to the present invention.

FIGS. 2A–2E illustrate a process flow for fabricating a field emission device on a silicon substrate 2, such as single crystalline silicon, polysilicon, amorphous silicon, etc, according to a preferred embodiment of the invention. As shown in FIG. 2A, thermal oxidation or deposition is applied to the silicon substrate 2 to form oxides or nitrides thereon. After etching and patterning the oxides or nitrides, a capping layer 20 is formed onto the surface of the silicon substrate 2. Capping layer 20 is preferably silicon oxide or silicon nitride, which functions as a self-aligned mask for defining the emitter of the field emission device, as discussed in greater detail below.

Figure 2B:
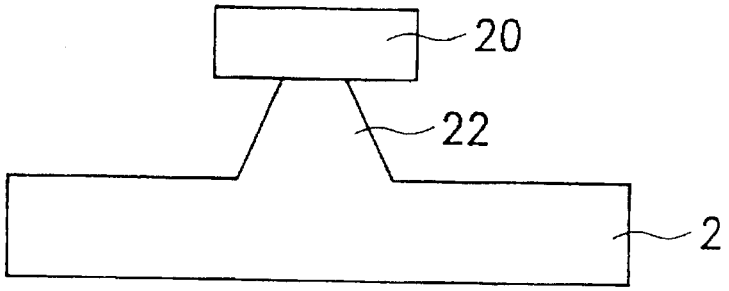

Referring to FIG. 2B, silicon substrate 2 is etched, with capping layer 20 functioning as a mask, to form a silicon pedestal 22 projecting therefrom. Preferably, a wet etchant, such as a mixture of $HNO_3$, $CH_3COOH$, and HF serving as an isotropic etchant or a mixture of KOH, $N_2H_4$, E.P.W. (ethylene diamine-pyrocatechol-water) serving as an anisotropic etchant, is employed to etch the silicon substrate 2. The top portion of silicon pedestal 22 adjacent to capping layer 20 is preferably less than 1 μ in width.

Figure 2C:
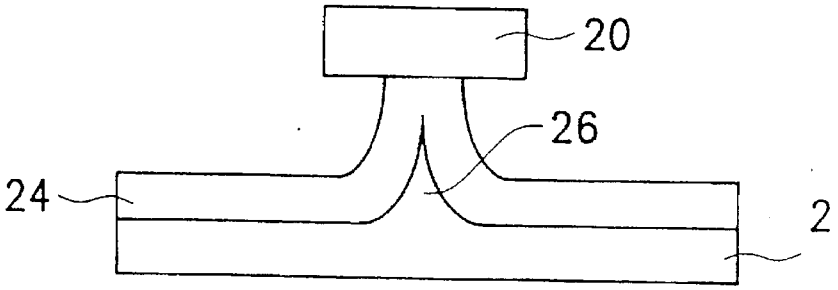

As shown in FIG. 2C, a dielectric layer 24 is formed on the side walls of the silicon pedestal 22 and the surface of the silicon substrate 2. Preferably, dielectric layer is formed by a conventional thermal oxidation process. This process consumes a portion of the silicon material, thereby sharpening silicon pedestal 22 into a silicon tip 26. Since dielectric layer 24 is formed directly on silicon pedestal 22 by an oxidation process, layer 24 will extend to the bottom surface of capping layer 20. This allows the gate aperture to be defined by the thickness of dielectric layer 24, as described in more detail below.

Figure 2D:
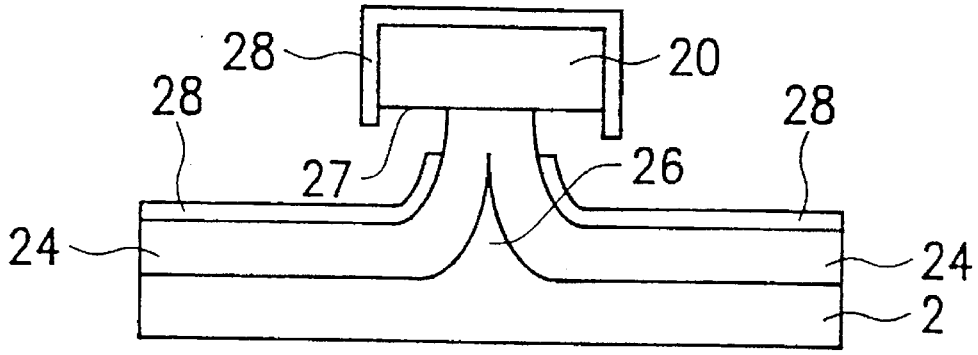

Referring to FIG. 2D, a metal layer 28, such as Cr, W, or Mo, is deposited on the top surface and side walls of capping layer 20. Metal layer 28 is also deposited over most of dielectric layer 24 except a portion of the dielectric layer adjacent a bottom surface 27 of capping layer 20. The thickness of metal layer 28 is preferably about 2000 Å. Metal layer 28 is deposited with perpendicular directional physical vapor deposition, e.g., E-gun evaporation.

Figure 2E:
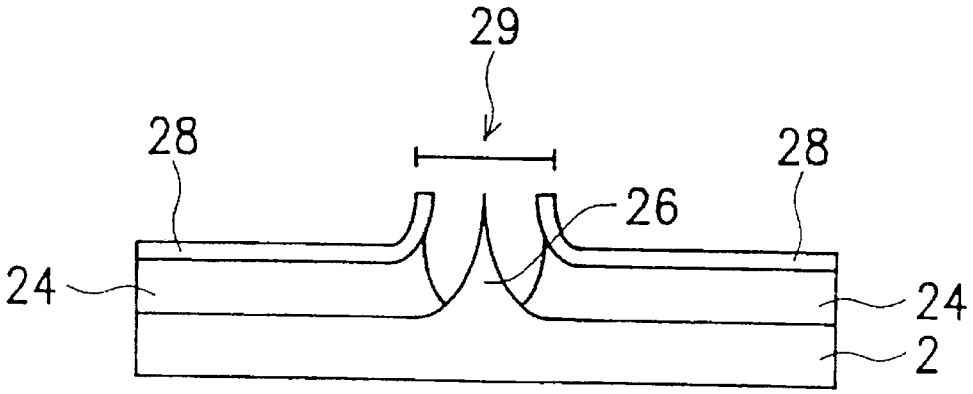

Finally, diluted hydrofluoric acid is employed to etch the exposed portion of dielectric layer 24 beneath capping layer 20, as shown in FIG. 2E. Capping layer 20 and the portion of metal layer 28 disposed thereon are lifted off the device along with the etched portion of dielectric layer 24 to expose silicon tip 26 as an emitter. The remaining metal layer 28 serves as a gate having a gate aperture 29 that defines the spacing between the emitter and the gate. Referring to both FIGS. 2D and 2E, it can be seen that the gate aperture 29 will have a width substantially equal to twice the thickness of dielectric layer 24. Thus, dielectric layer 24 can be formed with a submicron thickness so that a submicron sized gate aperture is obtained.

Figure 3A:
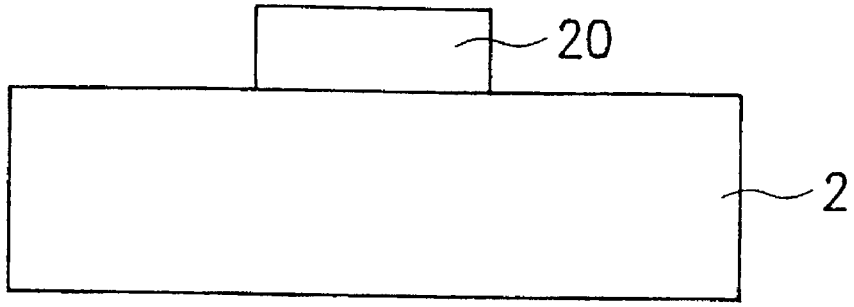
FIGS. 3A–3B depict an alternative embodiment of the process flow shown in FIGS. 2A–2E.
Figure 3B:
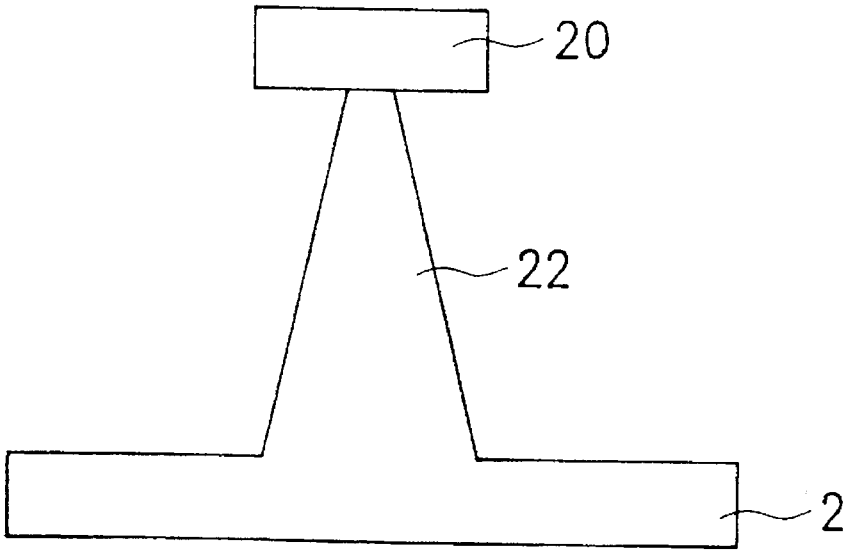

FIGS. 3A–3B depict an alternative embodiment of the above described process flow. Referring first to FIG. 3A, capping layer 20 is formed on silicon substrate 2 to serve as a self-aligned mask, similar to the process described above and shown in FIG. 2A. Substrate 2 is then subjected to anisotropic reactive ion etching, making use of gases $SF_6$ and $Cl_2$, to form a silicon pedestal **22*a*, as shown in FIG. 2B. Since $SF_6$ produces isotropic etching and $Cl_2$ produces anisotropic etching, silicon pedestal 22*a* has a larger ratio of height to half-width than in the preferred embodiment. This ratio can be adjusted by controlling the flow rate ratio of $Cl_2/SF_6$ and the RF (radio frequency) power of ECR (electron cyclotron resonance). Preferably, the flow rate ratio $Cl_2/SF_6$ is about 3/1 and RF power is about 50 W, thereby producing a silicon pedestal 22*a*** having a ratio of height to half-width of greater than 2. The remaining process flow is the same as described in the preferred embodiment.

Figure 4A:
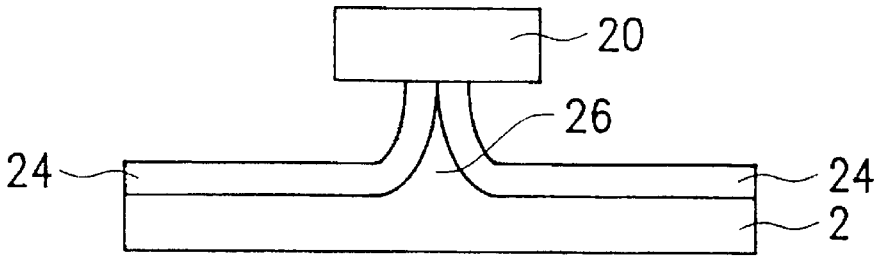
FIGS. 4A–4C depict a further embodiment for fabricating a field emission device.
Figure 4B:
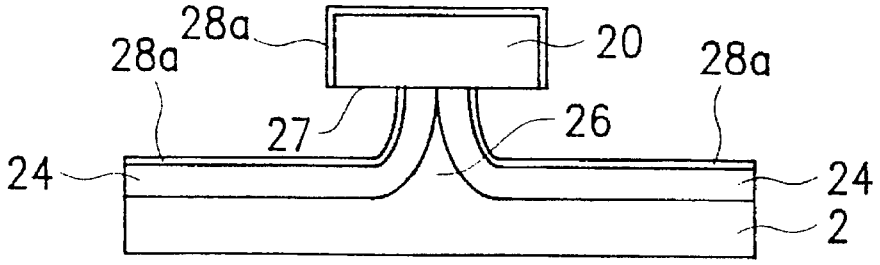
Figure 4C:
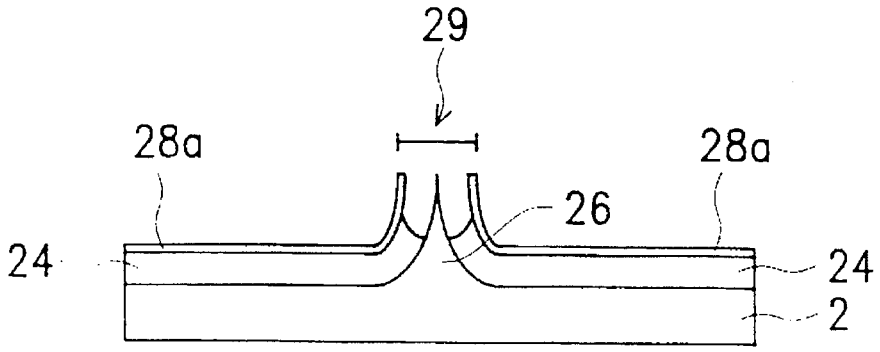

FIGS. 4A–4C illustrate the process flow of another embodiment of the present invention. After finishing the steps of the preferred embodiment illustrated in FIGS. 2A and 2B, silicon pedestal 22 and silicon substrate 2 are subjected to a thermal oxidation process (preferably exceeding 800° C.) to form dielectric layer 24 over the side walls of silicon pedestal 22 and the surface of silicon substrate 2, as illustrated in FIG. 4A. Because this oxidation process consumes the silicon constitution of silicon pedestal 22, silicon pedestal 22 is sharpened into a silicon tip 26. As shown in FIG. 4B, metal layer **28*a* is then deposited onto the top surface and side walls of capping layer 20, and the dielectric layer 24 by sputtering, i.e., with less deposition direction. Because the sputtering technique typically produces inferior step covering, metal layer 28*a* is cut off at bottom surface 27 of capping layer 20**.

Finally, diluted hydrofluoric acid is employed to lift off capping layer 20 together with the portion of metal layer **28*a* formed thereon and to etch a portion of dielectric layer 24 to expose silicon tip 26. Similar to the preferred embodiment, the width of aperture 29 is limited by dielectric layer 24 (about two times the thickness of dielectric layer 24), but is unrelated to the width of capping layer 20. Consequently, gate aperture 29** can have a width less than a micron without the use of submicron lithography technique.

Figure 5A:
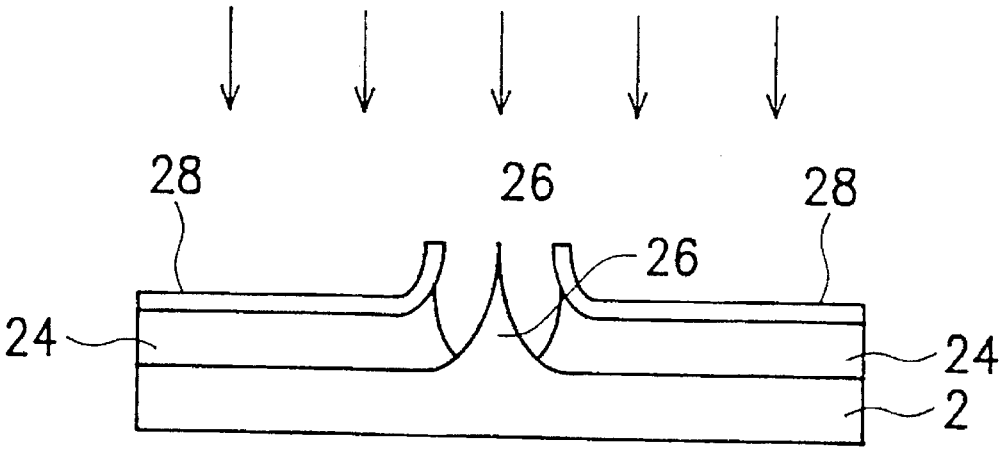
FIGS. 5A–5B depict yet another embodiment according to the principles of the present invention.
Figure 5B:
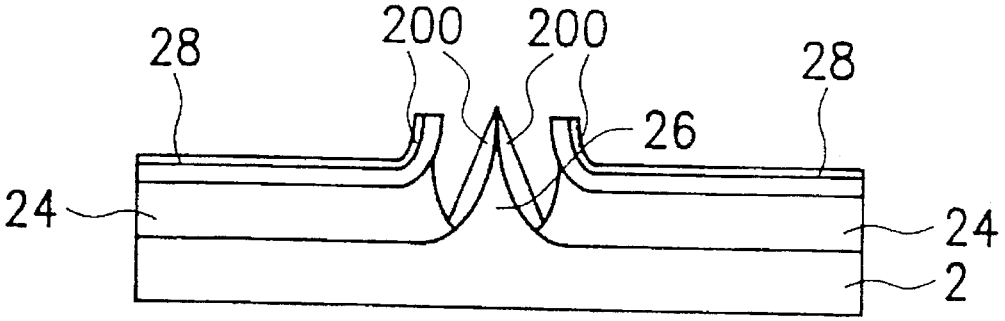

FIGS. 5A and 5B illustrate yet another embodiment of the present invention. After silicon tip 26 has been exposed, a conducting layer 200, such as metal (e.g., Al or W) or silicide (e.g., $CrSi_x$, $TiSi_x$, $WSi_x$, $MoSi_x$, $PdSi_x$, $PtSi_x$, $BaSi_x$, or $TaSi_x$), is selectively deposited over the exposed silicon tip 26 and metal gate 28 by chemical vapor deposition. This increases the surface electrical conductivity and the thermal conductivity, thereby prolonging the reliability and the lifetime of the field emission device.

In conclusion, by means of the present invention, the method for fabricating a field emission device (FED) can produce a dielectric layer with superior dielectric properties and uniformity because it is formed by thermal oxidation.

Moreover, since the size of the gate aperture is accurately controlled by the thickness of the dielectric layer, a submicron sized gate aperture can be manufactured and the operating voltage can be greatly reduced. It is further noted that all process steps are compatible with the standard CMOS process without requiring the purchase of additional equipment.

While the invention has been described in terms of what are presently considered to be the most practical and preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed:

1. A self-aligned method for fabricating a field emission device on a silicon substrate comprising:

(a) forming a capping layer overlying a portion of said silicon substrate;

(b) etching and patterning said portion of said silicon substrate into a silicon pedestal having sidewalls;

(c) forming a dielectric layer over said sidewalls of said silicon pedestal and said silicon substrate, thereby sharpening said silicon pedestal into a silicon tip;

(d) forming a metal layer over said capping layer and over a first portion of said dielectric layer such that a second portion of said dielectric layer remains exposed; and (e) etching said second exposed portion of said dielectric layer and removing said capping layer and said metal layer thereon to expose a portion of said silicon tip.

2. The method as in claim 1 wherein step (b) is performed by a mixture of nitric acid, acetic acid, and hydrofluoric acid as a wet etchant.

3. The method as in claim 1 wherein step (b) is performed by a mixture of potassium hydroxide, hydrazine, and ethylene diamine-pyrocatechol-water as a wet etchant.

4. The method as in claim 1 wherein step (b) is performed by anisotropic reactive ion etching.

5. The method as in claim 1 wherein step (d) is carried out with a directional E-Gun evaporation.

6. The method as in claim 1 wherein step (d) comprises sputtering.

7. The method as in claim 1, wherein step (c) is performed by thermal oxidation.

8. The method as in claim 7 wherein said dielectric layer is silicon oxide.

9. The method as in claim 8 wherein step (e) is carried out with a buffered hydrofluoric acid.

10. The method as in claim 1, after the step (e), further comprising selectively forming a conducting layer over said metal layer and said exposed portion of said silicon tip.

11. The method as in claim 10 wherein said conducting layer is selected from the group consisting of metal, $CrSi_x$, $TiSi_x$, $WSi_x$, $MoSi_x$, $PdSi_x$, $PtSi_x$, $BaSi_x$, and $TaSi_x$.

12. The method as in claim 1 wherein said capping layer is made of silicon oxide.

13. The method as in claim 1 wherein said capping layer is made of silicon nitride.

14. A self-aligned method for fabricating a field emission device on a silicon substrate comprising:

(a) forming a capping layer overlying a portion of said silicon substrate;

(b) etching said portion of said silicon substrate into a silicon pedestal having sidewalls;

(c) forming a dielectric layer over said silicon substrate by thermal oxidation, thereby sharpening said silicon pedestal into a silicon tip, said dielectric layer substantially covering said sidewalls of said silicon pedestal;

(d) forming a metal layer over at least a first portion of said dielectric layer; and (e) etching a second exposed portion of said dielectric layer and removing said capping layer to expose said silicon tip.

15. The method of claim 14 wherein step (d) comprises forming said metal layer over said dielectric layer such that said metal layer has a discontinuity that exposes the second portion of said dielectric layer beneath a bottom surface of said capping layer, said discontinuity forming a gate aperture having a width substantially equal to twice the thickness of said dielectric layer.

* * * * *